US006819208B1

(12) United States Patent
Peghaire et al.

(10) Patent No.: US 6,819,208 B1
(45) Date of Patent: Nov. 16, 2004

(54) ELECTROMAGNETIC LINEAR ACTUATOR WITH POSITION SENSOR

(75) Inventors: Jean-Pierre Peghaire, Argenteuil (FR); Calogero Fiaccabrino, Cergy (FR); Yves Porcher, Le-Plessis-Bouchard (FR)

(73) Assignee: Johnson Controls Automotive Electronics, Osny (FR)

( * ) Notice: Subject to any disclaimer, the term of this patent is extended or adjusted under 35 U.S.C. 154(b) by 0 days.

(21) Appl. No.: 09/959,327

(22) PCT Filed: Apr. 19, 2000

(86) PCT No.: PCT/FR00/01022

§ 371 (c)(1),
(2), (4) Date: Oct. 23, 2001

(87) PCT Pub. No.: WO00/65204

PCT Pub. Date: Nov. 2, 2000

(30) Foreign Application Priority Data

Apr. 23, 1999 (FR) ..... 99 05203

(51) Int. Cl.[7] ..... H01H 3/00
(52) U.S. Cl. ..... 335/256; 251/129.01
(58) Field of Search ..... 251/129.01–129.19; 335/276–282, 256, 220–229, 205.7

(56) References Cited

U.S. PATENT DOCUMENTS 5,548,263 A * 8/1996 Bulgatz et al. ..... 335/274
5,636,601 A * 6/1997 Moriya et al. ..... 123/90.11
5,868,108 A * 2/1999 Schmitz et al. ..... 123/90.11
6,215,299 B1 * 4/2001 Reynolds et al. ..... 324/207.2

FOREIGN PATENT DOCUMENTS

DE 19913050 A1 * 3/1999

* cited by examiner

*Primary Examiner*—Lincoln Donovan
(74) *Attorney, Agent, or Firm*—Foley & Lardner LLP

(57) ABSTRACT

A ferromagnetic actuator having, in a housing, a ferromagnetic circuit defining an axial travel interval for an armature (22) of ferromagnetic material for axially driving a rod between two extreme positions in which the armature bears against poles of the ferromagnetic circuit, resilient return means provided to hold the valve at rest in a middle position between the extreme positions, and at least one coil carried by the circuit and enabling the armature to be brought in alternation into both positions. The rod carries a radially-magnetized bar of length not less than the travel distance of the armature, and the housing carries at least one magnetic flux sensor placed in a zone having low exposure to the field created by the coil(s).

25 Claims, 4 Drawing Sheets

ELECTROMAGNETIC LINEAR ACTUATOR WITH POSITION SENSOR

CROSS REFERENCE TO RELATED APPLICATIONS

This application is a § 371 of PCT/FR00/01022 filed Apr. 19, 2000 which claims priority to French application No. 9905203 filed Apr. 23, 1999.

BACKGROUND OF THE INVENTION

The invention relates to electromagnetic actuators for moving an armature carrying a drive rod in linear translation along the axis of the rod. A particularly important but non-exclusive application of the invention lies in actuators for bringing a valve alternately into an open position and into a closed position, and in particular to actuators for the valves of an internal combustion engine using spark ignition or compression ignition.

French patent application No. 98/12489 (FR-A-2 784 222) describes an electromagnetic actuator having, in a housing, a ferromagnetic circuit defining an axial displacement interval for a rod-driving ferromagnetic armature between two extreme positions in which the armature bears against poles of the ferromagnetic circuit, resilient return means being provided for holding the valve at rest in a middle position between the extreme positions, and at least one coil carried by the circuit and enabling the armature to be brought in alternation into the two extreme positions.

The electromagnetic means can comprise two coils placed on either side of the armature for which excitation attracts the armature respectively in a direction tending to close a valve, and a second electromagnet placed on the other side of the armature which, when excited, tends to bring a valve into a fully open position, for example. The embodiment described in patent application No. 98/12489, to which reference can be made, has, on the contrary, only a single coil mounted on the ferromagnetic circuit which is of a structure such that in combination with the armature it presents two stable magnetic flux paths both corresponding to an air gap of zero size between the armature and one of the poles of the ferromagnetic circuit.

Satisfactory operation of such an actuator requires initial adjustment so that the armature is at rest in a middle position between its extreme positions. For this purpose, adjustment members can be provided for adjusting the initial compression of one of the springs, e.g. means such as those described in the French patent application filed on the same day as the present application for "Dispositif réglable de commande de soupages et procédé de réglage d'un tel dispositif" [An adjustable valve control device and a method of adjusting such a device]. However it is necessary to have a sensor for sensing the position of the armature to make it possible to determine the position of the armature in the interval or air gap defined by the poles. Furthermore, good operation requires the energy delivered to the coil(s) to be sufficient to guarantee that the stroke of the armature is complete, but not excessive so as to avoid end-of-stroke impacts which would generate noise and wear.

To solve the second problem, application 98/12940 ensures that the energy applied during the final stage of armature displacement is determined by measuring the reluctance of the coils, which implies a ferromagnetic circuit such that there exists an almost linear relationship between the reluctance R(x) and the air gap x during the last fractions of the stroke prior to the armature sticking against the poles of the ferromagnetic circuit. That approach does not make it possible to measure the rest position of the armature.

SUMMARY OF THE INVENTION

The invention seeks in particular to provide an actuator of the above-defined type provided with means making it possible to determine the rest position of the armature inaccurate manner.

To this end, the invention provides in particular an actuator whose rod or housing carries a radially magnetized bar of length not less than the travel of the armature, and in which the housing or rod carries at least one magnetic flux sensor placed in a zone which is weakly exposed to the fields induced by current passing through the coil. The sensor can be a Hall effect sensor, in particular.

A Hall effect sensor has a response that is substantially linear as a function of field, thus making it possible to track travel of the magnet by measuring its output signal. Furthermore, sensor drift whether due to temperature or aging is slow, which means that recalibration need be performed only periodically in order to identify the signal corresponding to the armature being in its middle position.

The bar can be fixed to the rod, which facilitates the requirements of the sensor. In order to reduce sensitivity to alternating accelerations, the disposition can be inverted.

In order to reduce the effects of any external disturbing components, while also increasing the useful signal, the detector can have two sensors whose sensitivity directions are opposite and which are placed on either side of the rod, with a subtracter receiving the outputs from the two sensors. Thus, external effects which are equivalent on both sensors cancel.

When both sensors are carried by the housing, they can be placed side by side on a common silicon substrate, with ferromagnetic circuits conveying fluxes sensed on either side of the rod to respective ones of the sensors and with a subtracter receiving the outputs from the two sensors.

The invention also provides a method of adjusting an actuator, comprising the steps of:

- bringing the armature into one of its extreme positions by feeding the or one of the coils and measuring the output signal from the sensor;
- taking the armature to its other extreme position and measuring the output signal from the sensor; and
- determining the output signal corresponding to the middle position of the armature on the basis of the measured signals.

The bar can be on the rod and the sensor on the housing. The disposition can be inverted, in order to accommodate magnet fragility.

For an actuator having a single coil, of the kind described in application 98/12489 (FR-A-2 784 222), the intensity of the magnetic field in the plane of symmetry of the magnetic circuit containing the axis of the armature is small enough for it to be possible to place the sensor therein without taking special precautions. The normal to the plane of the sensitive element of the probe is placed in said plane of symmetry. In contrast, in a circuit having two coils, where the two coils are oriented in planes orthogonal to the displacement axis, it is generally necessary to shield the ends of the coils, e.g. by making the yoke of the actuator out of ferromagnetic material.

The above characteristics and others that are advantageously usable in combination with the preceding characteristics but which are capable of being used independently will appear better on reading the following description of a particular embodiment given by way of non-limiting example.

BRIEF DESCRIPTION OF THE DRAWINGS

The description refers to the accompanying drawings, in which.

DETAILED DESCRIPTION OF THE EXEMPLARY EMBODIMENTS

Figure 1:
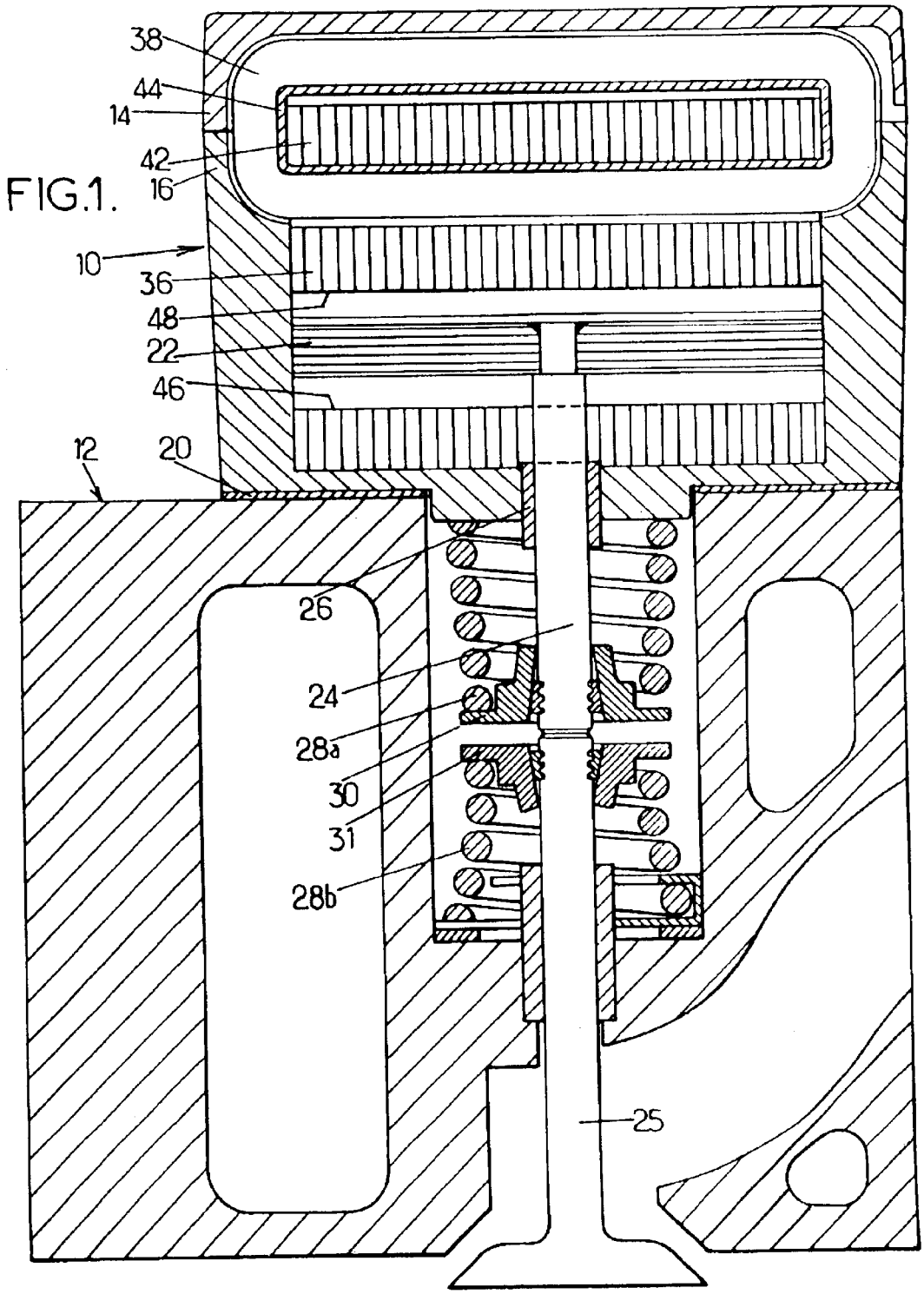
FIG. 1 shows a valve actuator to which the invention is applicable, in section on a plane containing the axis of the valve.

The actuator 10 shown in FIG. 1 is of the type described in application FR 98/12940 and intended to control an engine valve. It comprises a housing for mounting on the cylinder head 12 of an engine, constituted by a plurality of parts that are stacked and assembled together by means (not shown) such as screws.

These parts are made of non-ferromagnetic material, e.g. light alloy. The housing can be fixed on the cylinder head 12 via a shim 20 that is likewise of nonferromagnetic material.

The actuator has a moving armature 22 of ferromagnetic material, advantageously laminated in order to reduce losses. It is fixed on a rod 24 for driving the valve 25. The armature is rectangular in shape and cannot turn within the housing. The rod 24 can be guided by a ring 26 fixed to an annular projection or chimney of the housing.

Two return springs 28*a* and 28*b* are provided to hold the valve at rest in a substantially middle position between the closed position and the fully open position of the valve. The spring 28*a* is compressed between a plate 30 fixed to the rod 24 and means (not shown) for adjusting the compression of the spring. The other spring 28*b* is compressed between a plate 31 fixed to the stem of the valve and the bottom of the valve well formed in the cylinder head. The actuator can also be used with a single spring operating in traction/compression and associated with a resilient damper for ensuring that the valve is sealed when closed, as described in French patent No. 98/11670, thus making it possible for the rod and the valve stem to be made as a single piece.

The housing contains a core 36 of ferromagnetic material, advantageously laminated, co-operating with the armature to define a ferromagnetic circuit, and it also contains a coil 38 placed on the core. The circuit shown can comprise two complementary parts bearing against each other, or it can be made as a single piece. The laminations constituting each half of the core are E-shaped. The top branches 42 of the E-shape engage in the coil 36 which they support via a mandrel 44.

The other two branches of each half co-operate to define a travel volume for the armature. When the armature bears against the bottom 46 of the volume it defines a fully open position for the valve. The ceiling 48 of the volume is positioned relative to the valve seat in such a manner as to ensure that the armature bearing thereagainst does not prevent the valve from closing.

The assembly constituted by the armature, the valve, and the spring constitutes an oscillating system having its own resonant frequency. Under steady conditions, the coil is powered so as to bring the moving equipment into an extreme position and then lower current is applied to hold it there; thereafter, by switching off the current and then reestablishing it once the armature has reached a position such that it is attracted towards the other pole, the moving equipment is caused to move in the opposite direction until it comes into abutment.

The current in the coil can be servo-controlled by means of a regulation loop, and by implementing the method described in application 98/12940 at the end of the armature stroke.

The natural asymmetry of the top flux circuit relative to the bottom flux circuit can be emphasized by giving different slopes to the top and bottom pole surfaces and to the facing surfaces of the armature.

Figure 2:
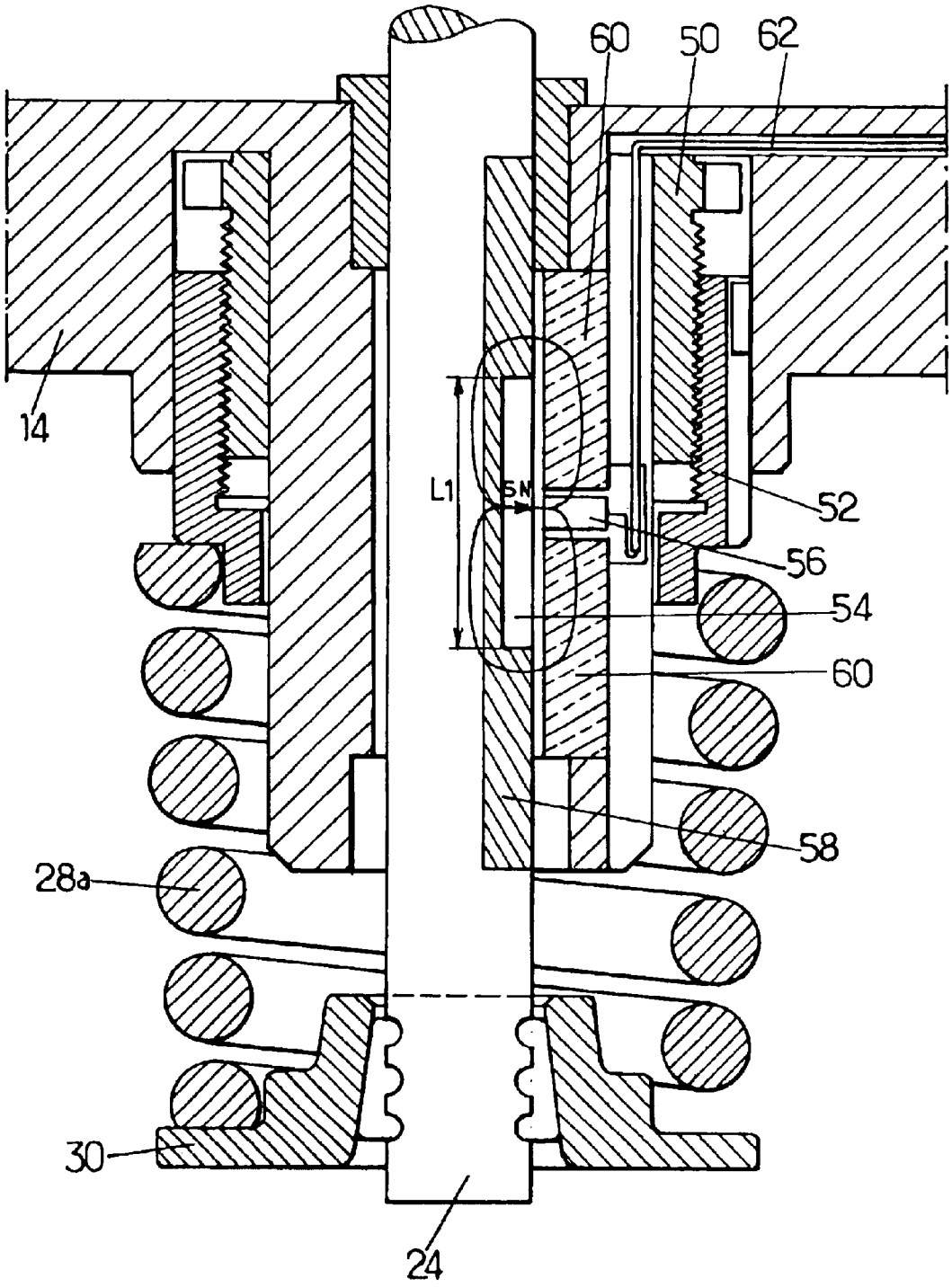
FIG. 2 is a detail view for showing the structure of the position-measuring means in an embodiment.

The actuator shown in part in FIG. 2 includes a device for adjusting the rest position of the armature by acting on the compression of the spring 28*a*. This device is constituted by a toothed wheel 50 bearing against the housing and a tapped ring 52 prevented from rotating by a key sliding relative to the housing and receiving the compression force from the spring 28*a*. By rotating the wheel from the outside, using means that can be of the kind described in patent application FR 99/05206, it is possible to adjust the rest position of the armature relative to the housing.

A detector for measuring the position of the rod and thus of the armature, relative to the housing comprises a magnetized bar 54 fixed to the rod 24 and placed facing a magnetic flux sensor 56, generally constituted by a Hall effect sensor and fixed to the chimney of the housing.

The axial length L1 of the bar is at least as long as the travel of the armature and the bar presents radial magnetization such that the field force lines it creates when the sensor is facing the center of the bar presents the appearance shown in FIG. 2. If the rod is non-magnetic, the metal portion of the rod can be separated from the bar by a bushing 58 of ferromagnetic material for guiding the lines of force. The sensor 56 is located between two plates 60 of ferromagnetic material for channeling the flux axially. The axial length of the plate on either side of the sensor is of the same order as the length L1 of the bar. Output wires 62 from the sensor 56 can be placed in a groove in the chimney.

If the rod is made of ferromagnetic material, then the bar can be fixed directly to a flat of the rod.

The azimuth plane containing the detector is selected so that the field induced therein by the coil is small. The symmetry of the magnetic circuit ensures that this field is practically zero in the plane of FIG. 1.

With a two-coil configuration, such a plane does not exist and consequently it is necessary to protect the sensor against the effect of the magnetic fields from the portions of the coils that are outside the iron. For this purpose, these portions, often referred to as coil "ends", can themselves be shielded by thin cases of ferromagnetic material for channeling the flux.

Figure 3:
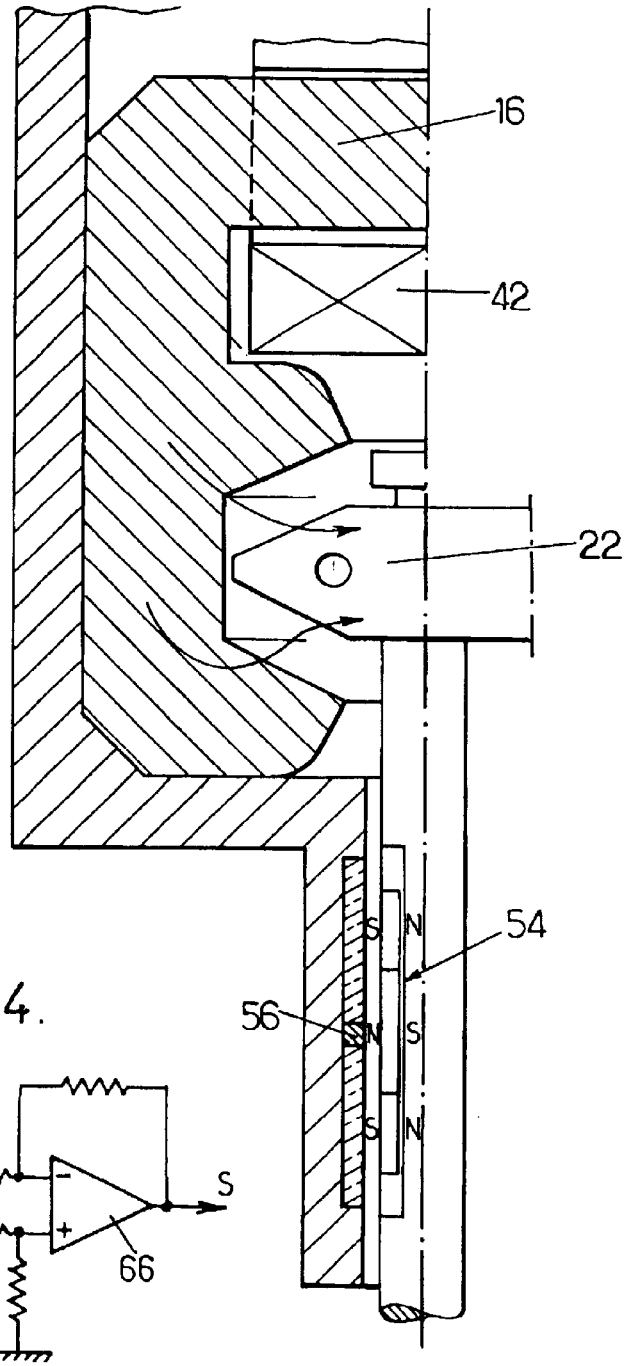
FIG. 3 shows a fraction of a variant of FIG. 2.

In the variant embodiment shown in FIG. 3, the magnetized bar 54 comprises three successive segments radially magnetized in opposite directions on going from one segment to the next, thus making it possible to track more accurately the displacement of the armature because of the larger amount of flux generated by the magnet. In yet another variant, the bar has three zones that are magnetized differently.

The use of magnets having a remanent field that remains strong (greater than 1 Tesla) even at high temperature.(e.g. magnets of the samarium-cobalt or of the neodyme-ironboron type) makes it possible to further increase the flux in the probe and the ratio of useful signal over disturbances coming from the coils.

Figure 4:
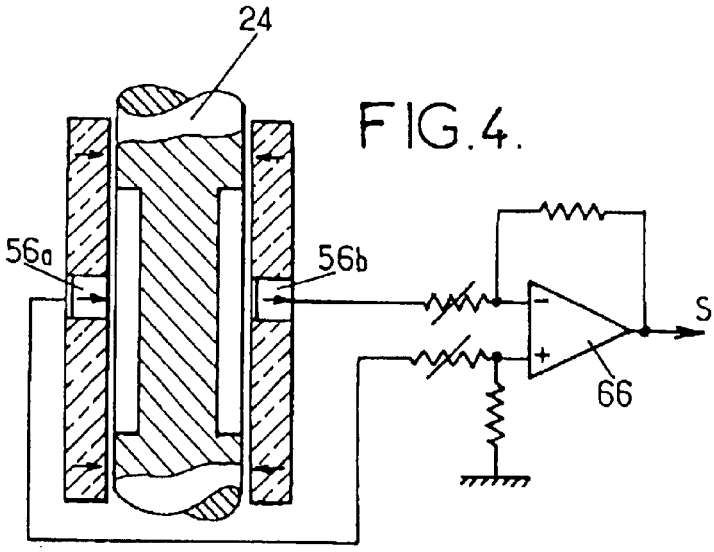
FIG. 4 is a diagram showing how two sensors are connected.

In some cases, particularly when a plurality of actuators are mounted side by side with magnetic circuit fractions in common (application FR 99/05206), each actuator can disturb the sensor of an adjacent actuator which is in an orientation about the axis of the rod that is favorable from the point of view of internal disturbances but unfavorable from the point of view of disturbances caused by an adjacent actuator. The effect of such an actuator can be practically eliminated with a differential configuration of the kind shown in FIG. 4, having sensors placed symmetrically about the rod, receiving substantially the same flux from the same actuator or adjacent actuator, and biased so as to provide working signals of opposite polarities. The two sensors 56*a* and 56*b* are of opposite polarities. Their output signals are applied to the two inputs of an analog subtracter 66 whose output S provides a working signal of double magnitude, while the residual error due to external disturbances no longer contains the common mode error when both sensors receive the same disturbing field.

Figure 5:
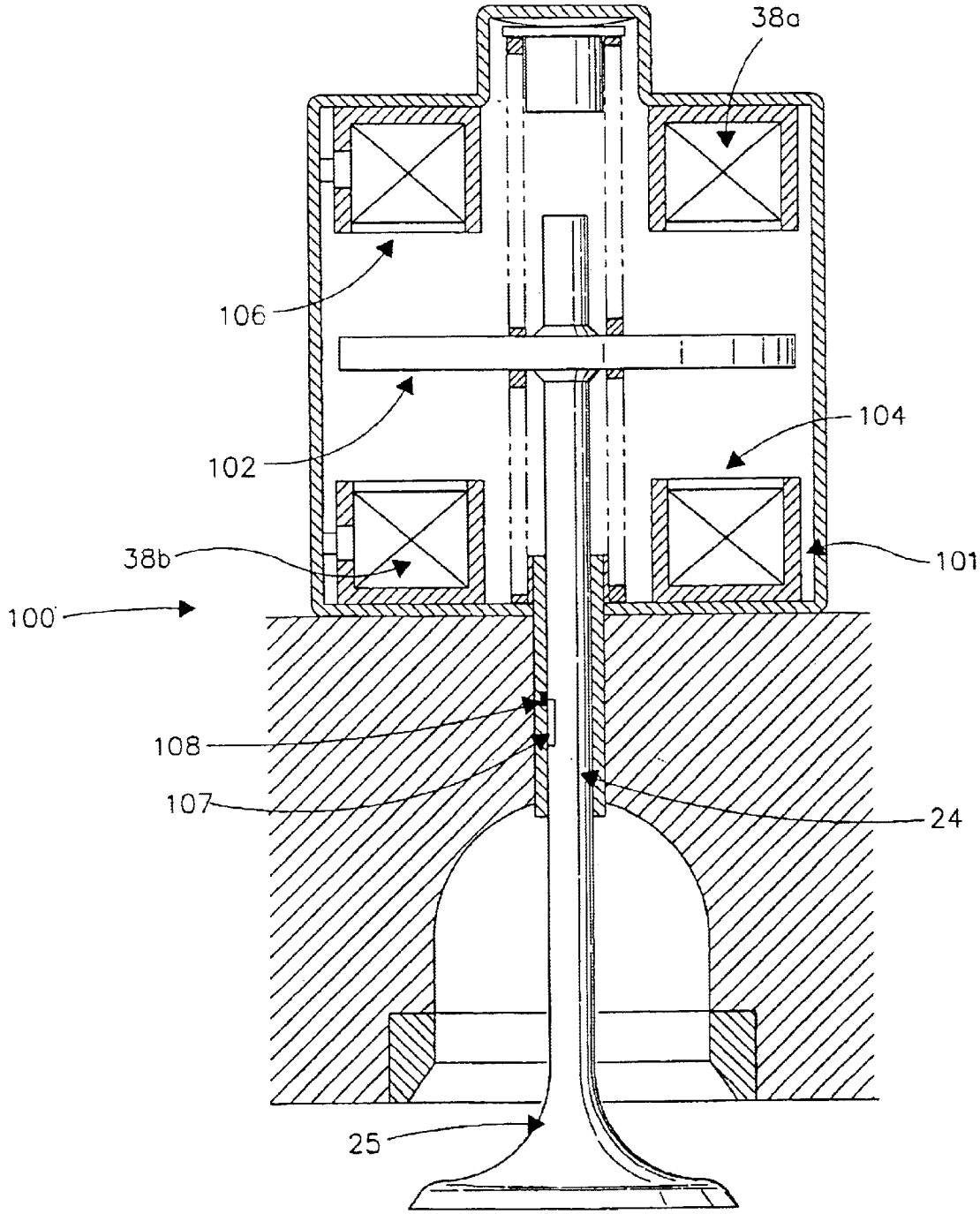
FIG. 5 shows an exemplary embodiment of a valve actuator.

Referring to FIG. 5, two coils 38*a*, 38*b* are oriented in planes orthogonal to the travel axis and are located in housing 100. The ends of coils 38*a*, 38*b* are magnetically shielded, such as by thin cases of ferromagnetic material 101 which channel the flux from the coils. The coils can be actuated to drive rod 24 between two extreme positions in which the armature 102 bears against the poles 104, 106 of the ferromagnetic circuit. Rod 24 carries a radially-magnetized bar 107 and housing 100 carries a magnetic flux sensor 108 such as a hall effect sensor. Magnetic flux-sensor 108 is shielded from the magnetization of coils 38*a*, 38*b* by ferromagnetic material 101.

What is claimed is:

1. An electromagnetic actuator having, in a non-magnetic housing, a ferromagnetic circuit defining an axial travel interval for an armature of ferromagnetic material for axially driving a rod between two extreme positions in which the armature bears against poles of the ferromagnetic circuit, resilient return means provided to hold the armature at rest in a middle position between the extreme positions, and at least one coil carried by the circuit enabling the armature to be brought in alternation into both positions, wherein at least one of the rod or the housing carries a radially-magnetized bar having a length not less than the travel distance of the armature for producing a position detecting flux and the other of the housing or the rod carries at least one magnetic flux sensor coupled to plates of ferromagnetic material for axially channeling the position detecting flux into the magnetic flux sensor, wherein the rod is made of non-magnetic material and the magnetized bar is fixed to a magnetic flux return plate extending on a side of the magnetized bar opposite to the magnetic flux sensor.

2. An actuator according to claim 1, wherein the sensor includes a Hall effect sensor.

3. An actuator according to claim 2, wherein the sensor is placed in a plane of symmetry of the ferromagnetic circuit.

4. An actuator according to claim 1, wherein the rod is ferromagnetic and the magnetized bar is fixed on a flat portion of the rod.

5. A method of calibrating an actuator according to claim 1, comprising the steps of:

bring the armature into one of its extreme positions by feeding one of the coils or coil, and measuring the output signal from the sensor;

bringing the armature into the other extreme position and measuring the output signal from the sensor; and determining the output signal corresponding to the middle position of the armature from the measured signals.

6. An electromagnetic actuator having, in a non-magnetic housing, a ferromagnetic circuit defining an axial travel interval for an armature of ferromagnetic material for axially driving a rod between two extreme positions in which the armature bears against poles of the ferromagnetic circuit, resilient return means provided to hold the armature at rest in a middle position between the extreme positions, and at least one coil carried by the circuit enabling the armature to be brought in alternation into both positions, wherein at least one of the rod or the housing carries a radially-magnetized bar having a length not less than the travel distance of the armature for producing a position detecting flux and the other of the housing or the rod carries at least one magnetic flux sensor coupled to plates of ferromagnetic material for axially channeling the position detecting flux into the magnetic flux sensor wherein the plates have an axial length on either side of the sensor which is substantially equal to the length of the radially-magnetized bar.

7. An electromagnetic actuator having in a non-magnetic housing, a ferromagnetic circuit defining an axial travel interval for an armature of ferromagnetic material for axially driving a rod between two extreme positions in which the armature bears against poles of the ferromagnetic circuit, resilient return means provided to hold the armature at rest in a middle position between the extreme positions, and at least one coil carried by the circuit enabling the armature to be brought in alternation into both positions, wherein at least one of the rod or the housing carries a radially-magnetized bar having a length not less than the travel distance of the armature for producing a position detecting flux and the other of the housing or the rod carries at least one magnetic flux sensor coupled to plates of ferromagnetic material for axially channeling the position detecting flux into the magnetic flux sensor further comprising two sensors placed symmetrically about the rod and biased so as to provide working signals of opposite polarities applied to inputs of a subtracter.

8. An electromagnetic valve actuator comprising:

a housing;

a rod;

an electromagnet configured to move the rod; and a first position detector, the first position detector comprising a magnetic material and a magnetic flux sensor configured to detect magnetic flux from the magnetic material, the magnetic material physically coupled to one of the housing and the rod and the magnetic flux sensor physically coupled to one of the housing and the rod such that as the rod moves its position with respect to the housing can be determined; and a second position detector placed symmetrically about the rod as the first position detector, the first position detector and the second position detector biased so as to provide working signals of opposite polarities applied to inputs of a subtracter.

9. The actuator of claim 8, further comprising a valve wherein movement of the rod facilitates opening and closing of the valve.

10. The actuator of claim 8, wherein the sensor is a hall effect sensor.

11. The actuator of claim 8, wherein the electromagnet is configured such that energization of the electromagnet can cause movement of the rod in at least two directions.

12. The actuator of claim 11, wherein the magnetic flux sensor is a hall effect sensor.

13. The actuator of claim 11, wherein a plane of a sensitive element of the sensor is placed perpendicular to a plane of symmetry of the electromagnet that contains the axis of the rod, the plane of symmetry representing a plane in which a magnetic field of the ferromagnetic circuit is small.

14. The actuator of claim 8, wherein:

the electromagnet is a first electromagnet;

the actuator further comprises a second electromagnet, the first and second electromagnets being oriented orthogonal to the travel axis of the rod; and the sensor is shielded from magnetism of the first and second electromagnets.

15. The actuator of claim 8, wherein operation of the electromagnet is controlled based on a signal from the first position detector.

16. The actuator of claim 14, wherein the sensor is shielded from magnetism of the first and second electromagnets by ferromagnetic material configured to shield magnetic flux from coil ends of the first and second electromagnet.

17. The actuator of claim 16, wherein the ferromagnetic material comprises cases of ferromagnetic material.

18. The actuator of claim 16, wherein the ferromagnetic material channels flux.

19. The actuator of claim 8, further comprising an armature coupled to the rod, the armature configured to be moved between a first position representing a fully open position and a second position representing a closed position and having a rest position between the first position and the second position, wherein the sensor is configured such that the sensor may sense a position of the armature when the armature is at a middle position between the first position and the second position; and the rest position is adjustable, and may be adjusted such that the rest position, as sensed by the sensor, may be brought to a position halfway between the first position and the second position.

20. The actuator of claim 8, wherein flux from the magnetic material is channeled axially into the sensor by a ferromagnetic material.

21. An actuator according to claim 6, wherein the sensor includes a Hall effect sensor.

22. An actuator according to claim 21, wherein the sensor is placed in a plane of symmetry of the ferromagnetic circuit.

23. An actuator according to claim 6, wherein the rod is ferromagnetic and the magnetized bar is fixed on a flat portion of the rod.

24. An actuator according to claim 7, wherein the sensor includes a Hall effect sensor.

25. An actuator according to claim 21, wherein the sensor is placed in a plane of symmetry of the ferromagnetic circuit.

* * * * *